US007721661B2

(12) United States Patent
Nelson et al.

(10) Patent No.: US 7,721,661 B2
(45) Date of Patent: May 25, 2010

(54) APPARATUS FOR COMBUSTION OF BIOFUELS

(75) Inventors: Eric W. Nelson, Minneapolis, MN (US); Marion L. Mast, Blooming Prairie, MN (US)

(73) Assignee: Hestia Heating Products, Inc., Minneapolis, MN (US)

( * ) Notice: Subject to any disclaimer, the term of this patent is extended or adjusted under 35 U.S.C. 154(b) by 716 days.

(21) Appl. No.: 11/550,494

(22) Filed: Oct. 18, 2006

(65) Prior Publication Data

US 2008/0092790 A1 Apr. 24, 2008

(51) Int. Cl.
*F23G 7/00* (2006.01)
*F23J 1/06* (2006.01)

(52) U.S. Cl. ..... 110/258; 110/170

(58) Field of Classification Search ..... 126/152 R, 126/152 B, 176 R, 155, 174; 110/258, 276, 110/278, 165 R, 170, 267, 275, 268; 414/153, 414/160

See application file for complete search history.

(56) References Cited

U.S. PATENT DOCUMENTS 2,348,762 A * 5/1944 Sturtevant ..... 110/275
2,524,868 A 10/1950 Worsham
4,201,186 A * 5/1980 Paquin ..... 110/267
4,312,278 A 1/1982 Smith et al.
4,553,487 A * 11/1985 Rasmussen et al. ..... 110/245
4,619,209 A 10/1986 Traeger et al.
4,947,769 A 8/1990 Whitfield
5,001,993 A 3/1991 Gramlow
5,123,360 A 6/1992 Burke et al.
5,137,010 A * 8/1992 Whitfield et al. ..... 110/170
5,285,738 A 2/1994 Cullen
5,383,446 A * 1/1995 Whitfield ..... 110/110
5,488,943 A * 2/1996 Whitfield et al. ..... 126/152 R
6,336,449 B1 1/2002 Drisdelle et al.
7,004,084 B1 2/2006 Anderson et al.
2004/0194679 A1 10/2004 Mendive et al.
2004/0200394 A1 10/2004 Krumrei

FOREIGN PATENT DOCUMENTS

WO WO-2006/081600 A1 8/2006

OTHER PUBLICATIONS

Harman Stove Company, "The Harmon P61 & P61A Pellet Stoves", Brochure, 4 pages.

(Continued)

*Primary Examiner*—Kenneth B Rinehart
*Assistant Examiner*—David J Laux
(74) *Attorney, Agent, or Firm*—Nawrocki, Rooney & Sivertson, P.A.

(57) ABSTRACT

A heating apparatus for the combustion of highly variable biofuel feed stocks is generally provided. The apparatus generally includes a combustion chamber or burn box adapted to receive a regulated feed of biomass. The burn box includes a grate for receipt of a distributed mass of the regulated feed, and further includes an oscillating blade adjacent to the grate for agitation of the distributed mass of the regulated feed received thereby. The combustion apparatus for the production of thermal energy from a biofuel of the subject invention is preferably and further characterized by means for producing the distributed mass of the regulated feed of biofuel, and/or a burn box incorporating an oxygen manifold assembly adjacent to the grate.

23 Claims, 9 Drawing Sheets

OTHER PUBLICATIONS

Harmon Stove Company, "The Harmon PC 45 Corn/Pellet Stove", Installation & Operating Manual, 28 pages.
PCT Written Opinion of the International Searching Authority, PCT Application No. PCT/US07/81774.
Communication Relating to the Results of the Partial International Search, PCT Application No. PCT/US07/81769.
PCT International Search Report, PCT Application No. PCT/US07/81774.

* cited by examiner

APPARATUS FOR COMBUSTION OF BIOFUELS

TECHNICAL FIELD

The present invention generally relates to biofuel burning heating devices, more particularly, to devices for the efficient production of thermal energy from biofuels such as pelletized, minimally processed, and/or raw biomass.

BACKGROUND OF THE INVENTION

With the further increasing costs of gas and fuel oil, combination with an ever increasing social consciousness directed to conservation and recycling, further attention is being directed to alternate fuel sources such as wood and other solid/semi-solid combustibles or combustible residues. A resurgence of interest and attention is being given to biofuels, biofuel combustion processes and biofuel combustion devices.

"Biofuel" is a term generally understood to embrace any fuel derived from biomass, namely, recently living organisms or their metabolic byproducts. Agricultural products specifically grown for use as biofuels include, among other things, corn, soybeans, flaxseed, rapseed and hemp. Furthermore, biodegradable outputs from industry, agriculture, forestry, and households, e.g., straw, timber, manure, sewage and food left-overs, can also be used to produce "bioenergy."

Heaters or stoves, more generally, "heating appliances," for burning biofuels are known to provide acceptable alternative heat sources for conventional heating units such as gas, electric and oil furnaces. Biomass pellets of a variety of compositions are well known fuel sources, as are cereal grains such as corn and wheat, to name but a few.

While many perceive pelletized fuel sources as being especially advantageous due to size uniformity and low moisture content, efficient energy producing combustion nonetheless requires attentive regulation of a variety of combustion parameters, for example, and without limitation, draft regulation, backfire prevention, thorough fuel conversion, and ash management/conditioning. In light of, among other considerations, increasing costs for pelletized biofuels due to increasing, and in some places, unmet demands for same, it is believed especially advantageous and desirable to utilize raw biomass fuel sources such as grains, which generally are readily available, and favorably priced on a per unit of energy produced basis.

Shortcomings and/or challenges associated with efficient biofuel combustion have been and continue to be well documented. For instance, U.S. Pat. No. 7,004,084 (Anderson et al.), the contents of which are incorporated herein by reference, identify a variety of challenges and, as the case may be, heretofore known approaches to those challenges, namely those of: fuel delivery (1:36 et seq.); initial fuel ignition and start-up (1:60 et seq.); clinker formation (2:34 et seq.); and, thermal operational optimization (2:48 et seq.).

In connection to fuel delivery, heretofore known pellet burners, corn stoves, etc. deliver, as by a direct auger dump, a mass of fuel at a select rate into a burn cup or fire pot (see e.g., U.S. Pat. No. 4,947,769 (Whitfield), U.S. Pat. No. 5,001,993 (Gramlow), U.S. Pat. No. 5,285,738 (Cullen), U.S. Pat. No. 5,488,943 (Whitfield et al.), and U.S. Pat. No. 7,004,084 (Anderson et al.). With reference to the subject teachings, whether the fuel is received in a cylindrical "cup" or elongate "pot," its ingress path is unencumbered; a straight shot from a direct dump orifice, generally overlying the cup or pot, to a fuel support structure or platform of the cup or pot (but see Gramlow '993 which shows fuel entry via a cup sidewall). For the most part, as the dumped fuel is received upon the fuel support structure, a fuel pile or concentrated mass of fuel forms thereon. As is common practice in elongate burn box arrangements, fuel enters from one end of the box, i.e., a narrow box end, and proceeds toward the opposing end while being consumed.

Anderson et al. '933, having flagged the delivery of corn kernels to the combustion chamber per se as a challenge, provide a pneumatically enhanced augered delivery of corn. Via a specially configured auger fuel feed tube, controlled air delivery thereto, pegged to a condition of a fuel agitator positioned within the ignited fuel, permits the fuel to be deposited proximal to the auger orifice during a low flow condition, or distal of the auger orifice during a high flow condition. In-as-much as the subject fuel delivery methodology is alleged to yield performance improvements, technician calibration and adjustment of such delivery system is a prerequisite.

In connection to fuel and/or ash conditioning, heretofore, burn pots have been equipped with a variety of mechanized arms and the like so as to "sweep" or otherwise direct spent fuel for discharge from the burn pot (see e.g., Whitfield '796, Cullen '738, or Whitfield '943), or to stir and mix materials in the bottom of the fire pot so as to maintain uniform combustion, remove ash and prevent clinker formation (see e.g., Gramlow '933 and Anderson et al. '933). Presently available commercial combustion appliances tend to feed fuel into a first end of a burn box via an auger, whereupon the entire mass of the fuel progresses towards the opposing end of the box while being mixed or stirred via an auger extension or the like to ensure complete fuel combustion, burning as it goes, with spent fuel exiting the chamber, commonly by dumping into an ash drawer, ash, clinkers and all. As heretofore known burn pots are intended to efficiently or optimally process fuel of a particular single or uniform character, e.g., pelletized, or minimally processed, or raw biomass, "optional" fuel specific burn pot assemblies, in the form of retrofit kits, are required and offered in the market place, see e.g., the Harman PC 45 Corn/Pellet stove.

Shortcomings with heretofore known burn box fuel agitators are believed twofold. First, the agitators are completely overburdened, or even surrounded by a mass of ignited, burning biofuel and/or a flame, and thus reach very high temperatures. In such environment, fuel impurities form deposits within the burn box which coalesce into a glass-like coating, necessitating periodic maintenance (i.e., removal and cleaning) for attainment of sought after thermal energy production. Second, the agitators seldom have an advantageous span to "reach" above or beyond the clumpy pile of ignited, burning biofuel. As a result, partially burned fuels create a "dome" above the fire that hinders, and often times prevents fresh fuel from entering the fire zone, a requisite for efficient operation.

In connection to initial ignition, start-up and thermal operational optimization, although incremental improvements have arguably been made, there remains ample room for improvement (see, e.g., Applicants' copending U.S. patent application Ser. No. 11,550,500, filed Oct. 18, 2006, entitled "Process Control Methodologies for Biofuel Appliance," incorporated herein in its entirety). Whether due to confinement in a "deep" cup or pot, localized accumulation in the pot per se, or owing to inadequate initial fuel delivery of post delivery fuel distribution and/or ash management, heretofore known combustion appliances necessarily produce a characteristic concentrated or narrow industrial flame, i.e., a "bunsen burner" look and feel. Furthermore, such devices are generally limited in their dynamic range, i.e., their ability to run at both very high and very low heat outputs, even when utilizing a single, uniform fuel source, e.g., a pelletized biomass, let alone when the biofuel may be variable from one heating event to another.

In light of the foregoing state of the art, and improvements or improved features in and of the new, i.e., last generation of biofuel heaters/heating appliances, there nonetheless remains great room for improvement, especially in the arena of non-industrial applications. It remains highly desirable to provide an apparatus which can, for, all practical purposes, efficiently operate with no on site calibration, modification, alteration, upgrade, retrofit, etc., and further still, provide an apparatus which can readily process a variety of biomass feed stocks as fuel, i.e., either or any of pelletized biomass, semi-processed biomass, or raw biomass, separately, or in combination. Furthermore, it remains desirably and advantageous to more efficiently handle fuel distribution and management, as well and improve upon heretofore known ash conditioning or management techniques. Finally, there remains a need to eliminate ignition and start up shortcomings, and provide a combustion process which is less dependent upon the plurality of heretofore adjustments in relation to one or more of fuel feed type, character or quality, fuel feed rate, and combustion air dynamic, flow and character.

SUMMARY OF THE INVENTION

A heating apparatus for the combustion of highly variable biofuel feed stocks is generally provided. The apparatus generally includes a combustion chamber or burn box adapted to receive a regulated feed of biomass. The burn box includes a grate for receipt of a distributed mass of the regulated feed, and further includes an oscillating blade adjacent to the grate for agitation of the distributed mass of the regulated feed received thereby. The combustion apparatus for the production of thermal energy from a biofuel of the subject invention is preferably and further characterized by means for producing the distributed mass of the regulated feed of biofuel, and/or a burn box incorporating an oxygen manifold assembly adjacent to the grate.

The burn pot or box is a vee-shaped enclosure that has a longitudinally extending mechanized grate which delimits a floor for the box. Rear and side walls of box are fixedly configured, while the "front" wall comprises the oscillating blade. Generally, combustion air is introduced into the burn chamber via apertures adjacent the mechanized grate, more particularly, a grate adapted for rotation. An oxygen injection manifold runs parallel and adjacent to the rotating grate along a fixed "back" wall of the box. The manifold assembly supplies supplemental concentrated oxygen into the fire zone of the burn box to ensure complete combustion, i.e., maximum conversion of the biofuel. This feature is especially advantageous during startup so as to avoid excess smoking associated with heretofore known conventional biofuel combustion appliances, and in furtherance of providing complete and reliable combustion with all biofuel types, particularly grains, including a fuel characterized by a mixed biomass.

The burn chamber readily and efficiently converts pelletized, minimally processed, and/or raw biomass into thermal energy for a variety of heating applications. Biomass is introduced into the burn box from a feed system which delivers the fuel to and/or upon a distribution block that distributes the fuel evenly across the burn box, more particularly, evenly and fully across the length of the grate. Characteristically, as the biomass begins to burn, clumps begin to form, thereby interfering in the process of burning the raw fuel down into fine ash, and expelling the ash from the burn box. Minimization, to the point of elimination, of clumping is achieved in great part by the oscillating motion of the blade which selectively, via reciprocation, breaks down any partially burned fuel clumps on the grate into an even ash. Enhanced functionality and performance is achieved for the blade due to, among other things, the fact that blade operates or functions with a substantial surface, i.e., one of the two blade surfaces, out of the flame or flame area.

In furtherance of fuel agitation and ash conditioning, the grate further supports such dual functionality. The grate, which is kept cool by the combustion air entering the burn chamber on all sides of the grate, is adapted to remove measured amounts of ash during actuation, namely, remove measured amounts of ash upon each rotation thereof. The rate of rotation for the grate is regulated so as to maintain an optimal ash layer. The ash layer provides an insulating layer below the burn zone that generally stabilized the flame. Furthermore, the rotating grate, along with adaptations permitting ash egress from the burn box, e.g., grooved ridges thereof or the like, further function to break up and remove clinkers, which tend to form in burning biomass when the ash is not agitated sufficiently, from the ash layer. With sufficient clinker buildup, critical burn zone space is effectively eliminated, with the combustion process being negatively affected or impacted.

A further advantageous feature, alone or in combination with other features of the subject invention, is the injection of oxygen into the burn zone via the oxygen manifold assembly. The excess oxygen, preferably supplied via a oxygen concentrator, eliminates the need to precisely adjust biomass feed rates, and combustion air rates. Supplemental oxygen injection, in combination with an insulating ash layer enabled by the functions of the oscillating blade and rotating grate, permit the apparatus of the subject invention to be run at all heat levels, and all biofuel types without further fuel specific user adjustments.

Finally, the apparatus of the subject invention further contemplates a burn box incorporating a sealing structure or member between the air wash duct and the oscillating blade of the burn box. Air openings into the burn chamber must be carefully controlled to maintain an optimal air/fuel mixture. Air is generally designed to go through one of three routes: (1) through the air wash duct that directs a cleansing flow of air against a front window of a combustion appliance incorporating the subject invention; (2) through the rotating grate opening gaps to serve as primary burn or combustion air; and, (3) through the adjustable secondary air duct at the front of the chamber to provide secondary air above the burn zone for maximum burn efficiency. As the blade, grate, and oxygen manifold assembly delimit a relative low pressure zone within the burn box, absent the air sealing member, there is a natural air leak between the front air wash duct and the oscillating blade. The air sealing member preferably includes a thin stainless steel member which traverses a gap extending from a portion of the air wash duct to the oscillating blade, more particularly, a lower portion thereof. Additional items, advantages and features of the various aspects of the present invention will become apparent from the description of its preferred embodiments, which description should be taken in conjunction with the accompanying drawings.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles, elements and interrelationships therebetween of the invention.

DETAILED DESCRIPTION OF THE INVENTION

Figure 5:
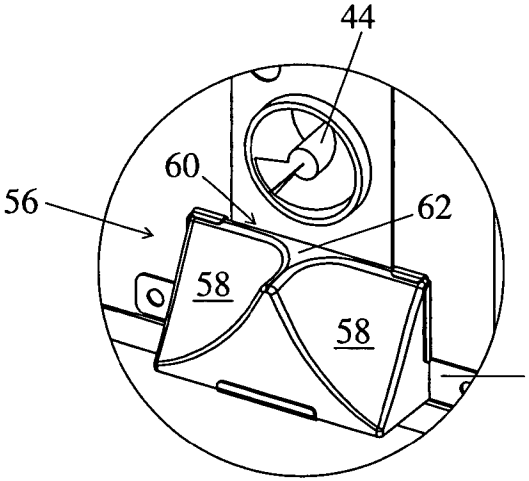
FIG. 5 is an enlarged detail of portion "5" of FIG. 1 depicting fuel ingress distribution means.
Figure 6:
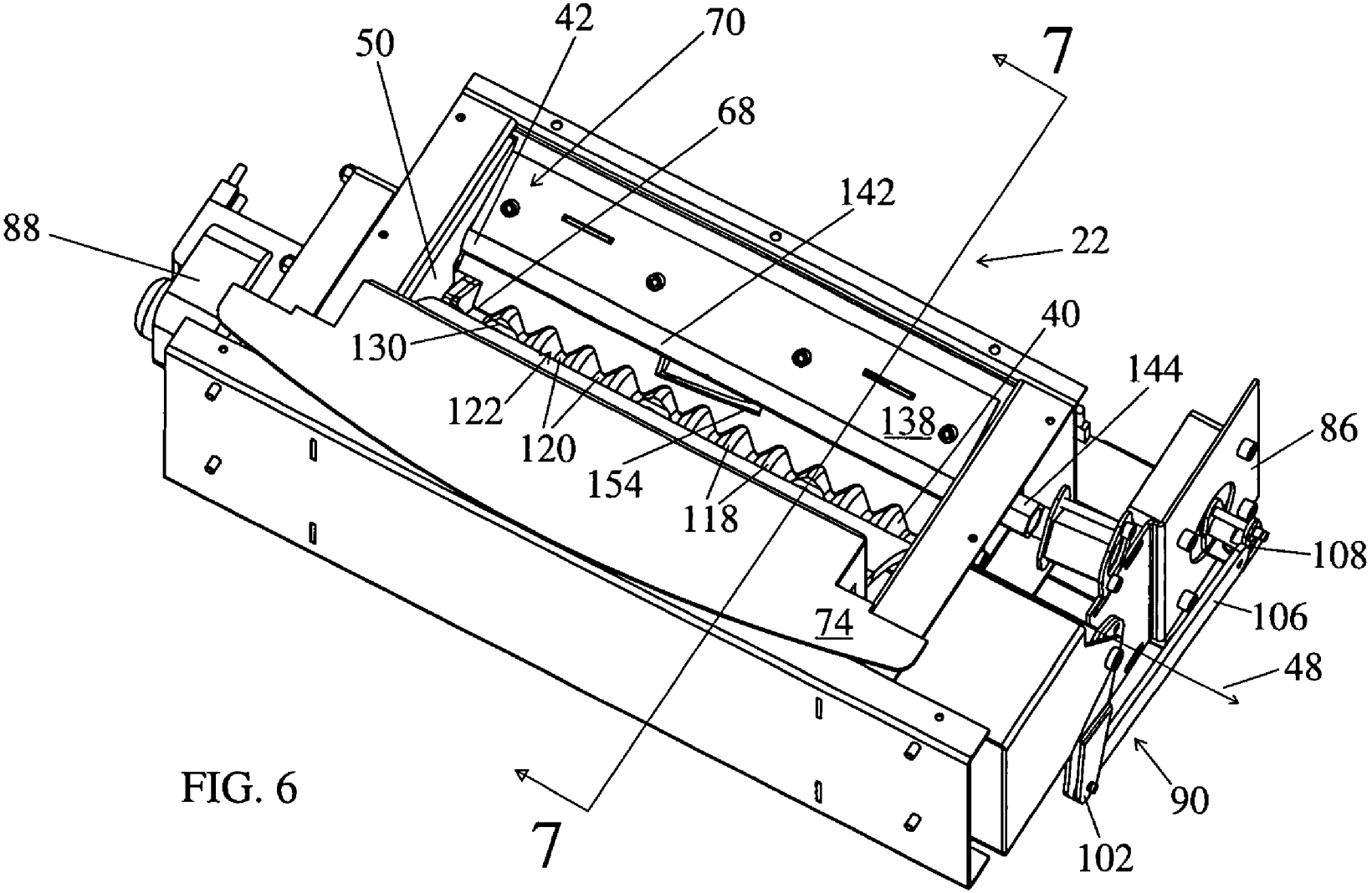
FIG. 6 is a top perspective view, slightly from the right, of the combustion chamber assembly of FIG. 1.
Figure 7:
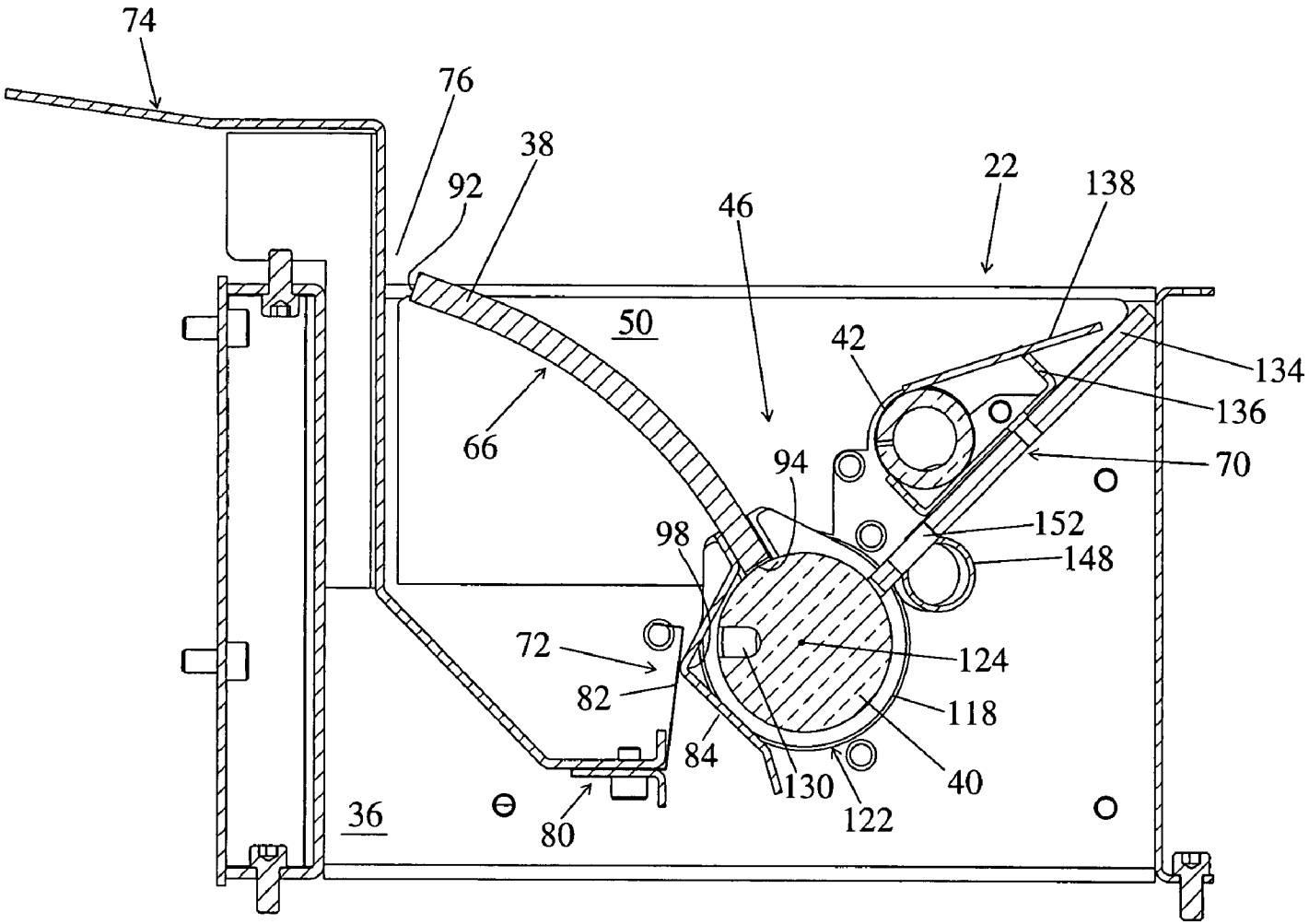
FIG. 7 is a sectional view about line 7-7 of FIG. 6 illustrating, among other things, elevational view interrelationships between and among the components of the combustion chamber assembly thereof.

The subject combustion device, per se and in combination with other elements or features of a heating appliance or the like, is generally depicted in FIGS. 1-4, 6 & 7, more particularly, FIGS. 1-4 are generally directed to components of a heating appliance while FIGS. 6 & 7 are specifically directed to a combustion chamber assembly. The remaining figures, namely FIGS. 5 & 8-10, depict advantageous features of contemplated appliance assemblies, and/or subassemblies of the subject invention, namely those associated with the combustion assembly of FIG. 6.

While the device of the subject invention, more particularly, the biomass fuel burner is especially well suited for inclusion in a residential or commercial heating appliance, e.g., a stove, it need not be so limited in utility. Contemplated applications for the subject invention, in all of its forms, whether they be in the context of an apparatus, process or methodolgy, need only have as a prerequisite or basis thermal energy production and/or utilization, more particularly, means of producing thermal energy from a biofuel.

With general reference now to the heating appliance 12 of FIGS. 1-4, a combustion device 14 is shown operatively combined with heat transfer means, namely, a heat exchange assembly 16 characterized by among other features, a cabinet 18 and heat exchanger tubes 20. To the extent they are used herein after, referential terms such as "up," "front," "lower," "right," "below," etc., are provided solely for the sake of facilitating the present discussion and are in no way intended to be limiting. Likewise, it is to be understood that heating appliances, such as that of FIG. 1 and/or those otherwise contemplated, further generally include one or more of a fuel feed system and supply, a combustible air intake system, an air exhaust system, and an ash box.

Figure 1:
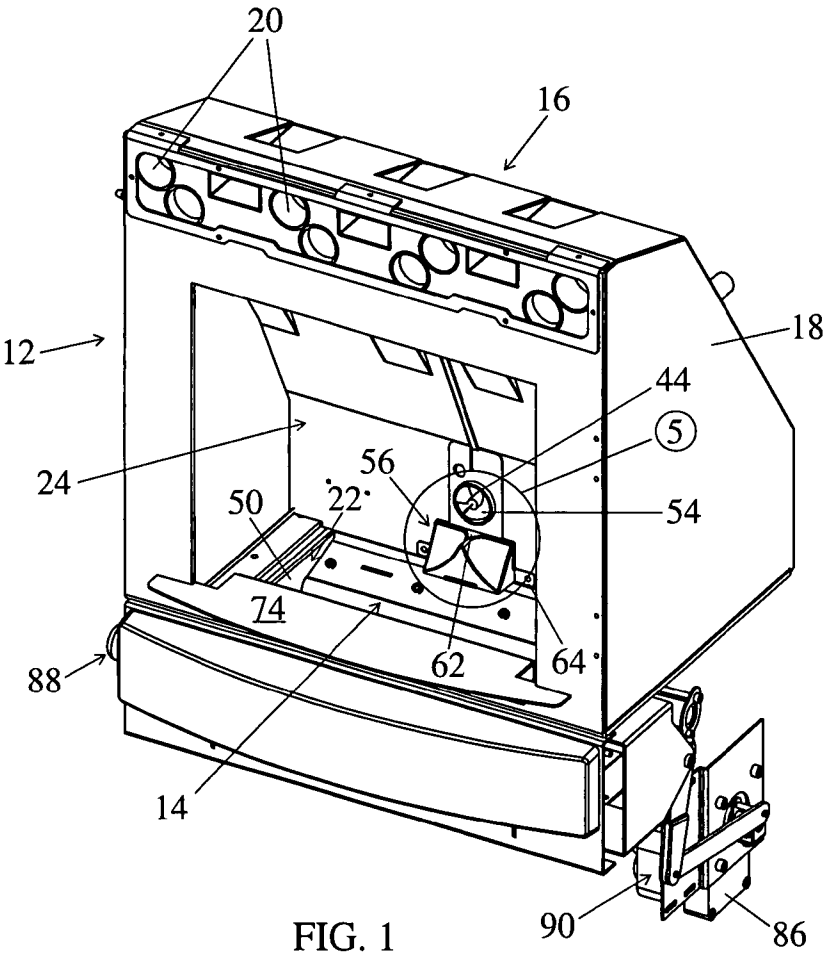
FIG. 1 is a front perspective view of select, cooperative components of a heating appliance, more particularly, a combustion chamber assembly in combination with heat transfer means.
Figure 4:
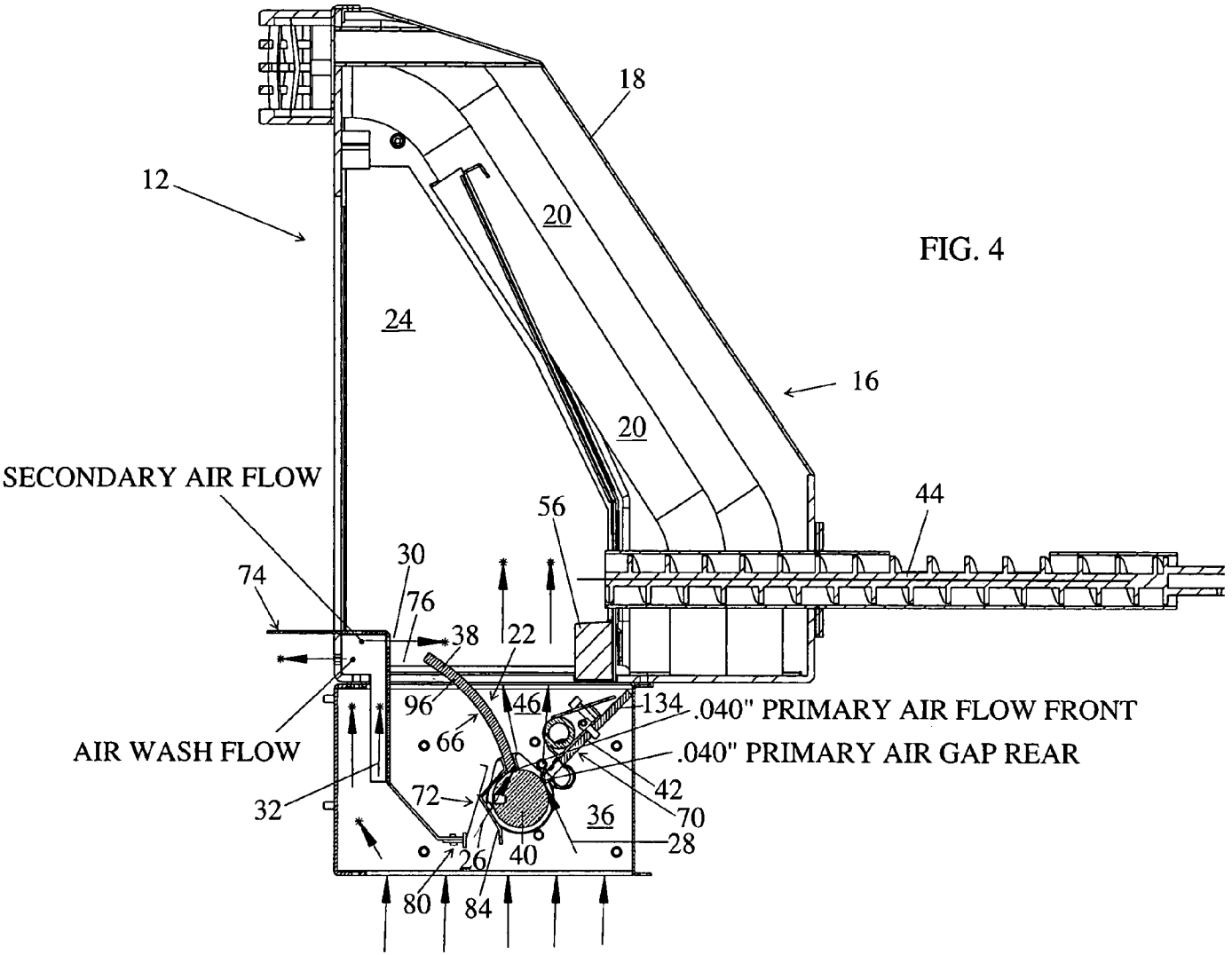
FIG. 4 is a sectional view about line 4-4 of FIG. 2 illustrating, among other things, elevational view interrelationships between and among the components of the appliance assembly of FIG. 1.

As a preliminary matter, and with particular reference to FIG. 4, the cooperative elements of the FIG. 1 heating appliance define a combustion chamber primarily characterized by a burn zone of a combustion device, more particularly a burn box or pot 22, and a head space 24, delimited, as shown, by an internal configuration of the heat exchange cabinet 18, overlying the burn zone for receipt of the gaseous combustion products. As noted, air flows are generally and selectively indicated, facilitated by gaps, chambers, passageways, etc., more particularly, primary combustion air feed (front 26 and rear 28), secondary combustion air feed 30, air wash 32, and supplemental oxygen feed 34.

The burn box 22 of the subject invention, which general resides within a plenum 36 overlying an ash box (not shown), is characterized by a variety of subassemblies, namely those associated with a mechanized blade 38, an elongate grate 40, and an oxygen manifold 42. The burn box 22 is generally adapted to receive a regulated feed of biofuel from a fuel feed system/supply, e.g., as by an auger 44 of such system as shown, more particularly, a distributed mass of the regulated feed of biofuel. Functionally, the burn box is intended to receive and substantially retain/contain the combustion inputs, (i.e., supplied biofuel, supplied excess air and an ignition source/means for initiating combustion), and sustain the dynamic combination of the combustion inputs as by appropriately directing the combustion products of the dynamic combination therefrom.

Prior to a further, more detailed presentation and discussion of the burn box, and the several subassemblies thereof, i.e., the representations of FIG. 6 et seq., several observations regarding fuel ingress into the combustion chamber of the subject invention are warranted.

Figure 3:
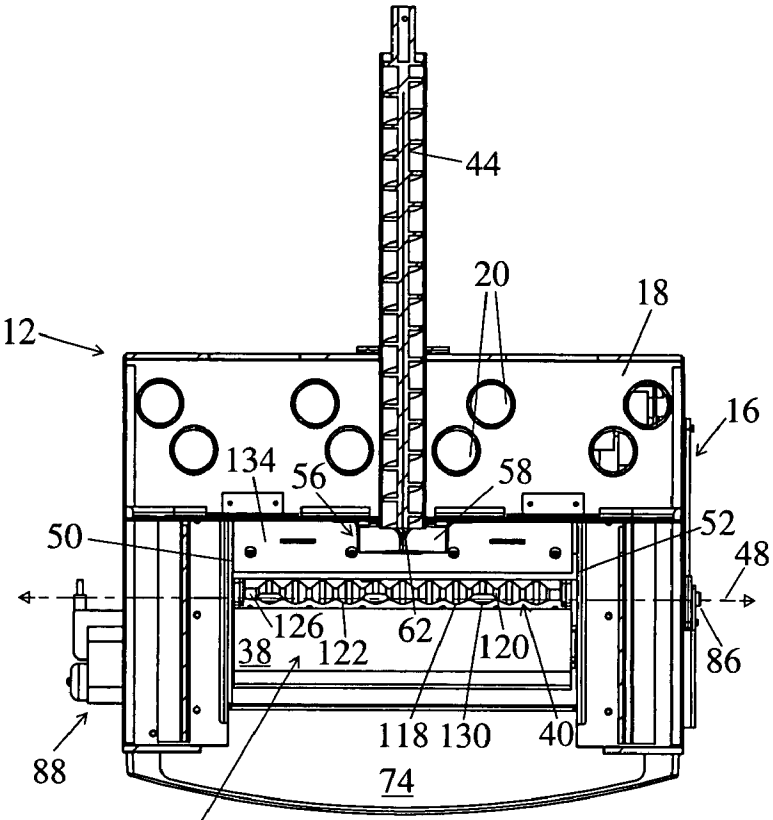
FIG. 3 is a sectional view about line 3-3 of FIG. 2 illustrating, among other things, plan view interrelationships between and among the components of the appliance assembly of FIG. 1.
Figure 2:
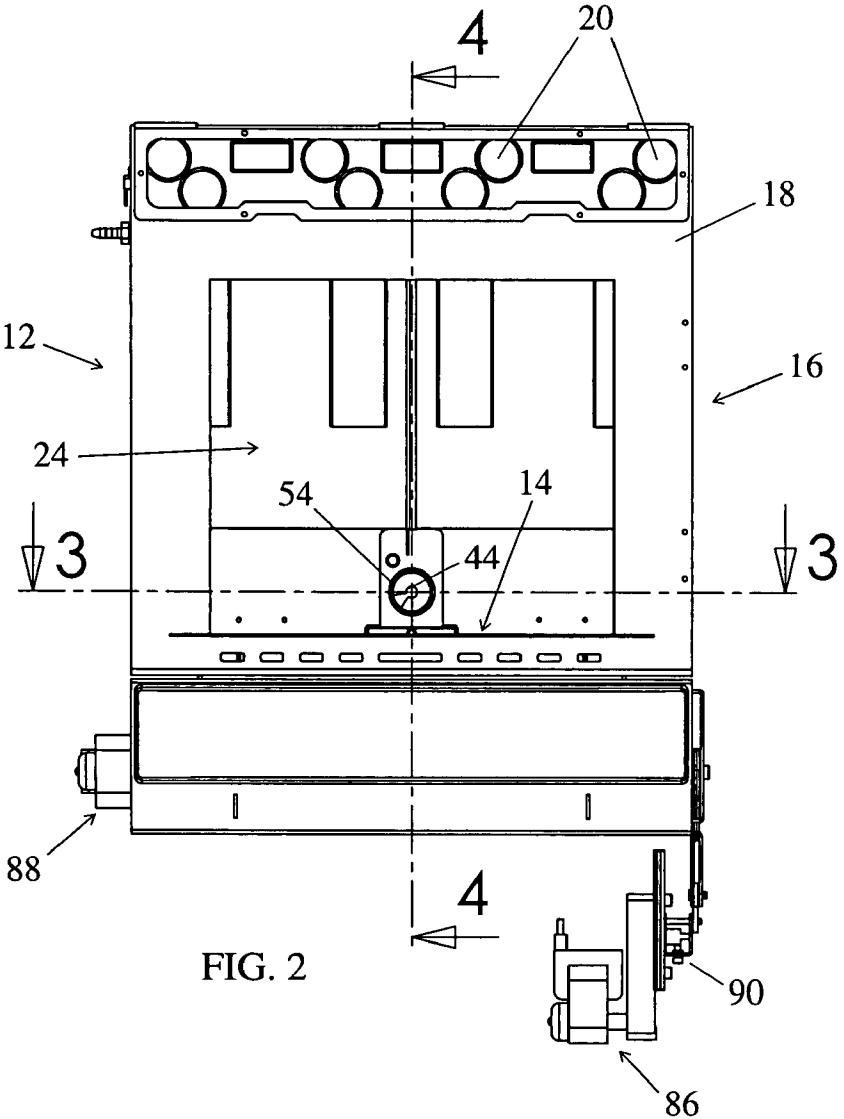
FIG. 2 is a front elevational view of the appliance assembly of FIG. 1.

As is best seen in connection to FIGS. 1, 3, and 4, fuel, in the form of either pelletized, semi-processed or raw biomass may be interchangeably, and even simultaneously introduced into the combustion chamber above a fire zone 46 (FIG. 4), and at a point overlying a central portion of the burn box (FIG. 3). In contradistinction to current approaches, biofuel enters the subject burn box transversely, i.e., the flow of regulated feed of biofuel is substantially orthogonal to an axis of elongation 48 of the burn box 22. Furthermore, and in contradistinction to heretofore known approaches, the fuel is introduced into the burn box 22 intermediate opposing end walls of the burn box, namely the left 50 and right 52 (i.e., lateral) sidewalls thereof.

Further in connection to fuel delivery, in-as-much as biofuel exits an orifice 54 of the feed auger 44 (see e.g., FIGS. 2 & 5), it does not directly dump into the burn box from the orifice. Instead, a distributed mass of the regulated feed of biofuel is received within the burn box, more particularly, upon the grate 40 traversing the sidewalls 50, 52 thereof. Distributing means, preferably in the form of a fuel distribution block 56 as shown in FIGS. 1, 3, and 4, and detailed in FIGS. 5-5C, is advantageously provided, more particularly, a flow splitting structure is positioned to receive and essentially divide the mass of biofuel exiting the fuel supply or delivery system.

Figure 5A:
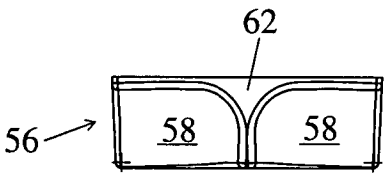
FIGS. 5A-5C depict top, front and side views of the distribution means of FIG. 5.
Figure 5B:
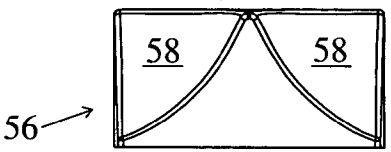
Figure 5C:
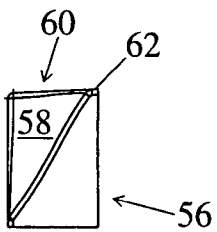

As is best seen with specific reference to FIGS. 5-5C, the distribution block 56 of the subject invention preferably includes primary fuel directing, e.g., deflecting, surfaces, more particularly, but not necessarily, concave surfaces 58. The block 56 further includes a top or upper surface 60 appearing as a stylized tee (FIG. 5A) characterized by a central rear planar fuel landing 62, delimited, as shown, via the arrangement of the contoured fuel directing surfaces 58. As to materials of construction, the block is advantageously, but not necessarily comprised of a low fouling or self-cleaning material, i.e., a material that prevents or reduces build up of non-gaseous combustion products, for example, ceramic. In-as-much as a fixture, e.g., bracket 64, is contemplated for retaining the block, numerous other suitable affixation mechanisms are known.

The subject block configuration greatly contributes to an advantageous fuel distribution across and throughout the width of the burn box, thereby enabling, and resulting in the highly desired log-like flame heretofore absent in biofuel heating appliances, namely, residential stoves. In-as-much as the preferred embodiment is especially advantageous, means for producing a distributed mass of the regulated feed need not be so limited. It should be apparent that alternate, substantially equivalent, whether structurally or functionally, designs and/or structures may be suitably provided, as by imposition between the feed discharge and the burn box, adaptation of the orifice of the feed discharge, or via an alternate fuel discharge means, e.g., a multiport discharge manifold for splitting, bifurcating or otherwise disintegrating the regulated feed of biofuel prior to receipt within the burn box.

With general reference now to FIGS. 1-6, and particularly to FIGS. 6 & 7, the subject burn box and combustion chamber defined thereby is a relative low pressure zone configured as an elongate open topped box of vee-shaped cross section which resides within a plenum. The burn box 22 is generally delimited by the blade 38 and the grate 40 of the blade and grate subassemblies 66, 68 respectively, and the oxygen manifold subassembly 70. As will be subsequently discussed, both the blade and the grate are dynamic elements, independently actuatable and/or operable, and as such, the combustion chamber is perhaps more accurately characterized as having a variable or dynamic cross section.

In furtherance of maintaining a regulated combustion environment within the active or dynamic burn box, a flexible element, e.g., sheet or panel 72, operatively links a portion of an air wash duct structure 74 to a portion the blade subassembly 66 so as to render inconsequential gap 76 that periodically forms between a free end of the active blade 38 and the air wash duct structure 74 (FIGS. 4 & 7). As should be readily appreciated, air flow into the burn chamber must be carefully controlled to maintain an optimal air/fuel mixture. In the subject configuration, combustion air is routed or otherwise directed: through the air wash duct to supply a cleansing air flow against and across front window; selectively through the grate via gaps or apertures to serve as primary burn air; and, through an adjustable secondary air duct at the front of the chamber to provide secondary air above the burn zone to maximize burn efficiency.

The sealing element 72, which maintains the desired air flow dynamics, is preferably, but not necessarily, a thin stainless steel construct, within the range of about 0.004 to 0.0010 inches, so as to keep internal stress low during operation. Sealing element 72 includes a first longitudinal edge portion 78 which advantageously retained by a duct bracket 80 or the like so as to be anchored for extension therefrom.

As illustrated (FIG. 7), a body portion 82 of sealing element 72 extends so as to be adjacent a blade bracket 84 of the blade subassembly 66, more particularly, the body 82 of the sealing element 72 is arranged relative to the blade bracket 84 such that cooperative frictional engagement is realized, and maintained. Via an inherent combination of resiliency and rigidity, as the distance between the free end of the active blade 38 and the air wash duct structure 74, i.e., gap 76, changes, the blade bracket maintains sealing engagement with the body of the sealing element so as to render the gap inconsequential, i.e., as the free end of the blade moves left to right in FIG. 7, the bracket bend rides up, on, and along the sealing element so as to maintain the integrity of the environment or space so defined.

With continued particular reference to FIGS. 6 & 7, and prior to a more detailed discussion of each of the discrete subassemblies illustrated, including their elements and configurations lending to a variety of synergies, a general overview or introduction with regard thereto follows. As previously noted, the combustion chamber is delimited by subassemblies directed to blade 38, more particularly an oscillating or reciprocating blade; elongate grate 40, more particularly a rotating fuel receiving and ash conditioning grate; and, oxygen manifold 42, more particularly, a supplemental oxygen manifold advantageously, but not necessarily supplied by an oxygen concentrator via a closed loop system.

The mechanized blade and grate elements 38, 40 substantially traverse the length, i.e., width, of the burn box 22 (FIGS. 4 & 6), with the subassemblies 66, 68 incorporating same being jointly or cooperatively supported at the opposed, fixed end walls, i.e., sidewalls 50, 52, of the burn box 22, as will later be explained. The blade 38 and the grate 40 are preferably, but not necessarily, separately actuated for steady or constant motion (i.e., oscillation and rotation respectively), as by dedicated gear motors 86, 88 respectively, or the like (see e.g., FIGS. 1, 2, 3, or 6), and appropriate linkages (see e.g., FIGS. 8 & 9). Although constant driving of the grate and blade are contemplated, as should be readily appreciated and is likewise contemplated, one or of the driving mechanisms may be pegged to one or more process parameters, e.g., grate rotation to the flow rate of incoming fuel, and blade oscillation to quality or efficiency indicia associated with combustion products.

Figure 8:
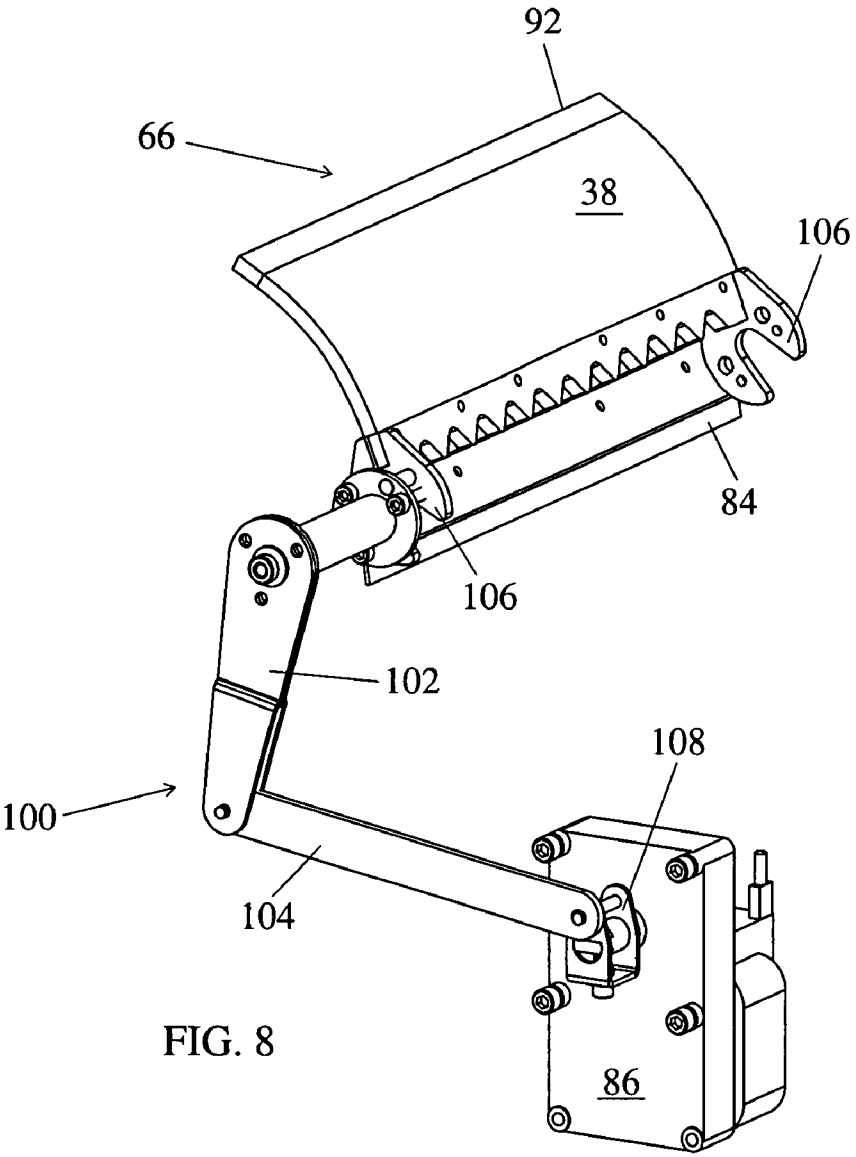
FIG. 8 is a right perspective view of components of a blade subassembly of the combustion chamber assembly of FIG. 6.

With particular attention now FIGS. 7 & 8, the blade subassembly 66 generally includes blade 38, blade bracket 80 and a drive interface 90. The blade preferably comprises an arcuate panel which functions to agitate fuel and ash supported upon the grate, and to stir and expose fuel for complete and more thorough combustion and lower ash conditioning.

The blade includes a free, first longitudinal edge portion 92, and opposite thereto, a second longitudinal edge portion 94 adapted to closely conform to and with the grate 40, more particularly, a scalloped or otherwise profiled or sculpted edge for operative integration with the profiled grate. Enhanced functionality and performance is achieved for the blade due to, among other things, the fact that blade operates or functions with a substantial surface, i.e., surface 96 of the two blade surfaces, out of the flame or flame area (FIG. 7).

The blade bracket or retainer 84 (FIG. 7) is generally configured so as to include a grate receiving bend or crotch 98, i.e., configured so as to position a longitudinal edge (i.e., "second" longitudinal edge 94) of the blade 38 adjacent the grate 40, and primarily serves as means for operatively linking the blade 38 to the driver 86 via the drive interface 90.

With particular reference now to FIG. 8, the drive interface 90 as shown generally includes a drive linkage 100 and driver 86. The linkage 100 advantageously but not necessarily includes a pair of link arms 102, 104 linkedly joined for pivot motion. A first link arm 102 fixedly extends from the blade subassembly 66, more particularly, indirectly from one of a pair of blade flanges or brackets 106 of the subassembly. A second link arm 104 extends from an offset arm 108 which is operatively linked to a shaft of the driver 86. Via the subject or equivalent alternate arrangement, a periodic blade oscillation is achieved. As will be discussed in connection with the grate of FIG. 9, the blade flanges or brackets of the subassembly support the grate.

Several functional advantages owing to the subject blade subassembly, directly or otherwise, are know. Primarily, the oscillating blade, acting as a fuel agitator, processes clumped and partially burnt fuel down into the burn zone. This assists in breaking up any clumping occurring in the ash, and further assists fuel spreading, which among other things, results in a wider more natural looking flame. In contradistinction to heretofore known agitators, the oscillating blade operates with one surface out of the flame or fire zone, i.e., is exposed to a lower temperature environment adjacent one side of the blade such that a low enough temperature is maintained, and glassy mineral buildup avoided. Furthermore, unlike rotating agitators which create a "dome" above the fire that prevents fresh fuel from entering the fire zone, the subject mechanized blade compresses and agitates all the fuel in the burn box.

Figure 9:
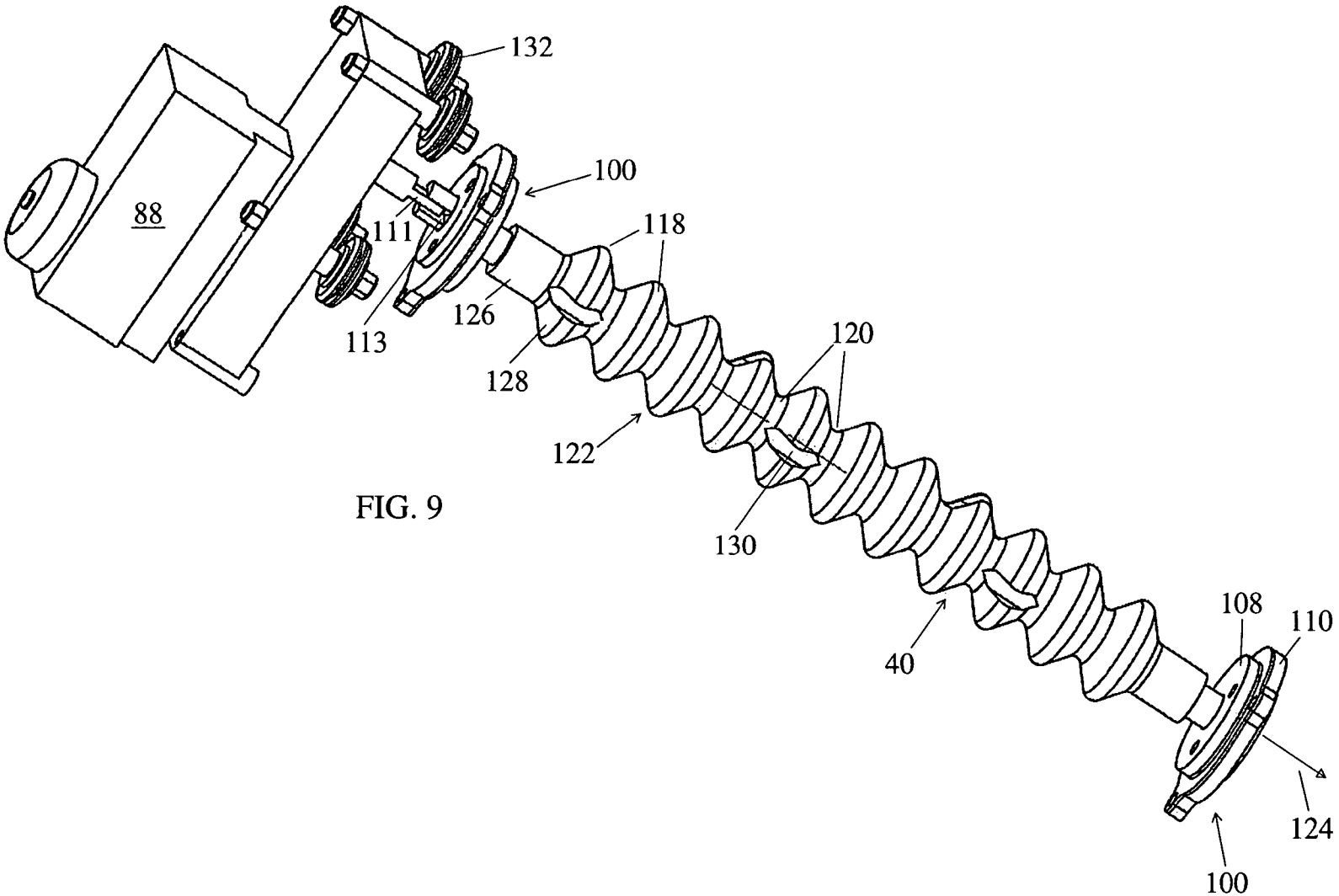
FIG. 9 is a bottom perspective view of a grate subassembly of the combustion chamber assembly of FIG. 6.
Figure 10:
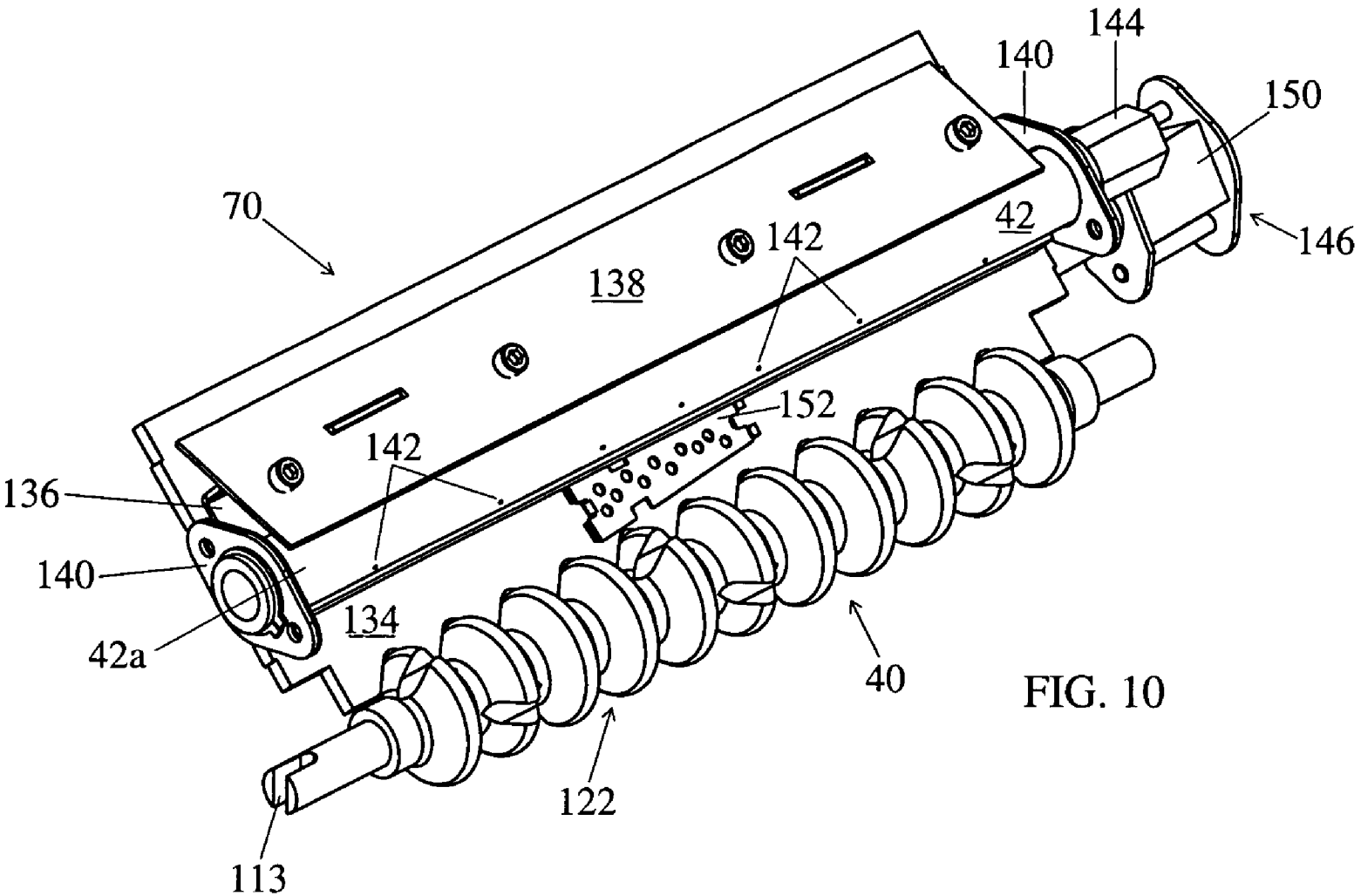
FIG. 10 is a top perspective view, from the left, of a manifold subassembly of the combustion chamber of FIG. 6.

With particular attention now FIG. 9, the grate subassembly 68 generally includes elongate grate 40 and actuation means, e.g., gear motor 88. The grate 40, as illustrated, and as perhaps best appreciate in connection to FIG. 10A, may be fairly characterized as having a plurality or series of periodic circumferential peaks 118, spaced apart by a plurality or series of periodic circumferential valleys 120 so as to delimit a periodically curved surface 122 longitudinally spaced from a axial centerline 124 thereof. In-as-much as a sinusoidal periodicity is illustrated, the configuration need not be so limited. Structurally, the grate may be viewed as comprising a shaft 126 having a plurality of discs or disc-like members or elements supported thereby, or extending therefrom, more particularly, notched discs 128 (FIGS. 9 & 10).

Notionally, the distributed mass of biofuel is received upon the grate, more particularly, supported upon and between the peaks, while non-gaseous combustion products are intended to be selectively directed into the valleys for eventual expulsion from the burn box. In furtherance of maintaining an optimal combustion environment, selective ash removal is essential. That is to say, careful maintenance of a conditioned ash layer helps insulate and create the burn zone just above the ash.

In addition to the indirect ash conditioning of the oscillating blade, i.e., as by processing clumped and partially burnt fuel, minimizing clinker formation, and fuel spreading, the subject grate, and contemplated variants directly condition the ash. Direct ash conditioning by the rotating grate 40 is greatly facilitated by notches 130, i.e., cut outs, of the notched discs 128. The notches 130 are of nominal width, generally extending laterally, i.e., parallel to the axial centerline 124 of the grate 40, so as to traverse a peak, i.e., for any given peak, a single notch laterally extends from a first immediately adjacent valley floor to a second immediately adjacent valley floor (see e.g., FIG. 10). A preferred, non-limiting notch arrangement includes notches sequentially and successively arranged or positioned, one disc to another, at about 90° radial intervals from the axial centerline of the shaft (e.g., disc one notch at 12 o'clock, disc two notch at 3 o'clock, disc three notch at 6 o'clock, and disc four at 9 o'clock).

Several functional advantages owing to the subject grate subassembly, directly or otherwise, are know. For instance, maintaining an ash layer around or about the grate helps insulate the grate from the high temperatures of the burn zone. The commensurate lower temperature of the grate eliminates the glassy clinker, or clinker-like build up that contaminates heretofore known ash conditioners. Furthermore, the rotating action of the grate breaks up the ash into a more uniform and significantly more compact form, thereby resulting in longer burning periods between ash dumps.

With continued reference to FIG. 9, opposing ends of grate 40 support paired grate bearings 110. The bearings 110, which includes inner 112 and outer 114 components as shown, are receivable at the paired brackets 106 of the blade subassembly 66 for operative support therebetween.

The drive mechanisms for animating the blade 38 and grate 40, more particularly, the gear motors 86, 88, are designed to connect swiftly, directly and surely to an element of each structure or subassembly. For example, and as shown in FIG. 9, a tang or shank 111 in the gear motor shaft is received within a slot 113 in a mating structure of the grate 40 or grate subassembly via simply pushing the motor and shaft together. The gear motor, preferably but not necessarily, is intended to be further pushed inward so as to engage elastomeric grommets 132 on the gear motor into corresponding rotationally arranged keyhole slots on the motor bracket. Advantageously, but not necessarily, the keyhole slots are characterized by a detent which assists retaining motor position. With and by such slot and tang arrangement, normal amounts of misalignment between the motor and drive shaft can be readily and easily accommodated. Furthermore, the motor, once the grommets are received within their corresponding key holes, can then be twisted into place for reversible integration therewith. The directionality of the "twist" is such that, as the motor runs, the developed torque will drive the motor fasteners further into the key holes.

Figure 10B:
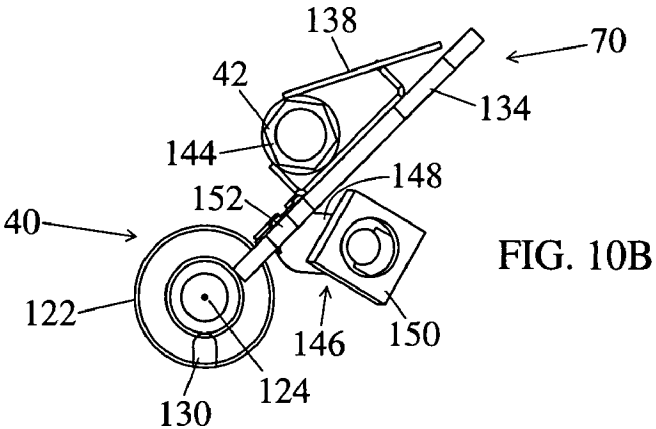
FIG. 10A is an rear elevation view, inverted, of the manifold subassembly of FIG. 10; and, FIG. 10B is an end view, from the right of the manifold assembly of FIG. 10.
Figure 10A:
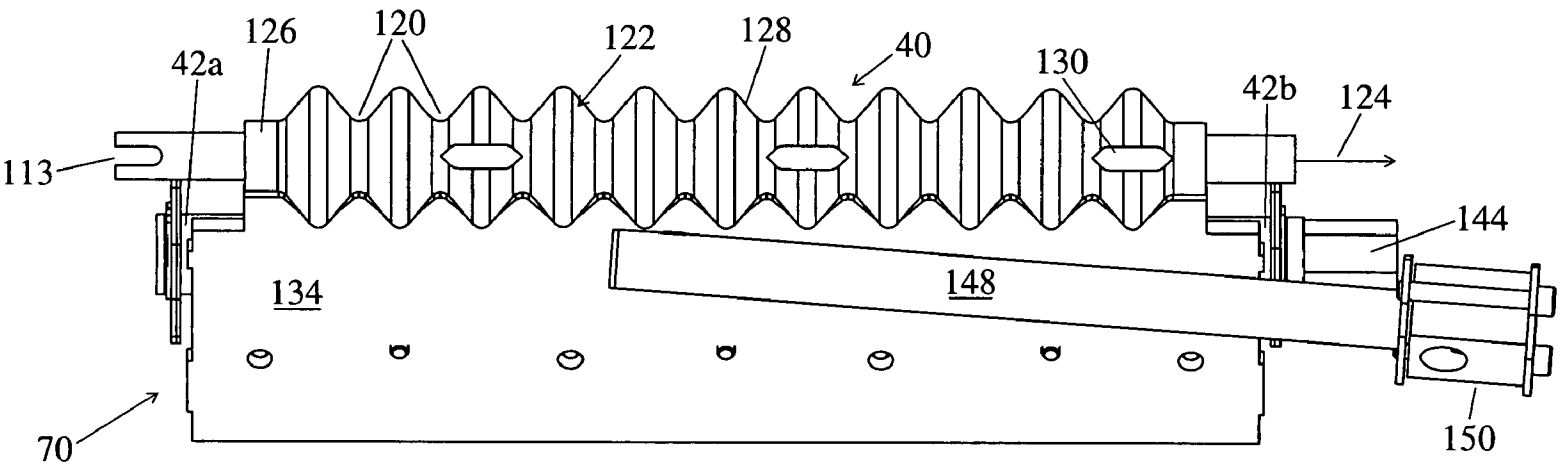

Referring now to FIGS. 10, 10A, & 10B, the oxygen or jet manifold assembly 70, shown in relation to the heretofore described grate, generally includes supplemental oxygen or jet manifold 42, a jet manifold plate 134, a jet manifold channel 136, and a jet manifold cover 138. The jet manifold 42, as the blade and the grate, substantially traverses the width of the burn box, and is generally supported at the opposing end walls, i.e., sidewalls 50, 52, of the burn box 22 by suitable hardware, for example manifold brackets 140 as shown.

The manifold includes spaced apart apertures or orifices (i.e., jets 142) for delivering oxygen into the burn zone, more particularly and preferably, a non-linear series of jets, and more particularly still, an arrangement of jets that, in relation to axial centerline 124 of the grate 40 (FIG. 10, see also FIG. 1) initially "rise" from a first manifold end 42*a* to a central "max," and thereafter "fall" toward a second manifold end 42*b*. Such jet arrangement along the length of the manifold is intended to mimic the burn zone profile, and thereby generally enhance combustion. It is to be noted that fitting 144, operatively linked to an end of the jet manifold 42 as shown, is supplied in furtherance of select manifold rotation, whether for fine tuning oxygen delivering into the burn zone via the manifold jets, or maintaining free passage of the oxygen delivery as will be later described.

The jet manifold plate 134, in addition to primarily serving as a rear burn box wall, a static version of the oscillating blade if you will, supports a variety of other subassembly elements or components directly or indirectly, namely, the jet manifold channel 136 and cover 138, as well as an igniter 146 within housing or tube 148 (FIGS. 10A & 10B). The manifold cover 138 generally extends in a supported condition across the width of the burn box 22 (FIG. 1), as well as up and rearward from the manifold 42 (FIG. 10B). Likewise, the jet manifold channel 136 generally extends in a supported condition upon the plate 134 so as to traverse the burn box. With the arrangement of FIG. 10B evidencing a spatial arrangement between and among the cover 138 and the channel 136 relative to the jet manifold 42, in combination with the ability to selectively rotate the manifold as previously described, select, cleansing of the manifold, as by a scraping, rotational engagement of the surface thereof with adjacent longitudinal edges of both the cover 138 and the channel 136 is possible.

Ignitor 146 generally includes a tube (not visible) extending from a fixture 150 adapted to receive an electrical power source and permit air ingress. The manifold plate 134 is generally adapted to receive a free end portion or segment of the ignitor housing 148, more particularly, the plate 134 includes an apertured covering 152 for a cut-out 154 or the like (FIG. 6) which permits communication between the burn box and ignition means originating in the ignitor 146.

Several functional advantages owing to the subject manifold subassembly, directly or otherwise, are know. Oxygen injection allows easy starting of any and all biomass fuel types by shortening the startup time, virtually eliminating the associated hallmarks of smoldering and smoking in present heating appliances, especial with non-pelletized fuels. The supremely efficient hot burn zone created by the supplemental oxygen delivery, in combination with the carefully maintained insulating ash layer, assures complete, efficient combustion of all fuels. Generally, use of supplemental oxygen yields a combustion dynamic which is highly insensitive to the combustion air fan setting, and more particularly, the subject subassembly eliminates the need to precisely adjust fuel feed rates, and further eliminates the need to regulate a combustion air flow/quality as a function of the quality or character of the biomass feedstock. Finally, utilization of an oxygen concentrator, as contemplated, as an oxygen source eliminates any possibility of a safety hazard owing to increasing an oxygen concentration in the local environment. This is due to the fact that the concentrator does not create oxygen, but merely, concentrates the oxygen near the flame. This closed loop system eliminates the possibility of creating a dangerous possibility of creating a dangerous concentration of oxygen in the appliance space.

There are other variations of this invention which will become obvious to those skilled in the art. It will be understood that this disclosure, in many respects, is only illustrative. Although the various aspects of the present invention have been described with respect to various preferred embodiments thereof, it will be understood that the invention is entitled to protection within the full scope of the appended claims.

What is claimed is:

1. A combustion appliance for the production of thermal energy from a biofuel, the appliance comprising a burn box adapted to receive a regulated feed of biofuel, said burn box including an elongate grate for receipt of a distributed mass of the regulated feed of biofuel and an oscillating blade adjacent to said elongate grate for agitation of the distributed mass of the regulated feed of biofuel received by said elongate grate, said oscillating blade being substantially co-extensive with said elongate grate, said elongate grate comprising a plurality of discs supported by a shaft.

2. The combustion appliance of claim 1 wherein each disc of said plurality of discs includes a notch to facilitate ash expulsion from said burn box.

3. The combustion appliance of claim 2 wherein notches of said notches of said each disc are sequentially arranged, one disc to a next disc, at about 90 degree intervals from an axial center line for said shaft of said elongate grate.

4. The combustion appliance of claim 1 wherein said burn box further includes an oxygen manifold assembly adjacent to said elongate grate.

5. A combustion appliance for the production of thermal energy from a biofuel, the appliance comprising a burn box adapted to receive a regulated feed of biofuel, said burn box including an elongate grate for receipt of a distributed mass of the regulated feed of biofuel and an oscillating blade adjacent to said elongate grate for agitation of the distributed mass of the regulated feed of biofuel received by said elongate grate, said oscillating blade being substantially co-extensive with said elongate grate, said elongate grate comprising a shaft from which extend a plurality of spaced apart circumferential peaks.

6. The combustion appliance of claim 5 wherein said burn box further includes an oxygen manifold assembly adjacent to said elongate grate.

7. A combustion appliance for the production of thermal energy from a biofuel, the appliance comprising a burn box adapted to receive a regulated feed of biofuel, said burn box including an elongate grate for receipt of a distributed mass of the regulated feed of biofuel and an oscillating blade adjacent to said elongate grate for agitation of the distributed mass of the regulated feed of biofuel received by said elongate grate, said oscillating blade being substantially co-extensive with said elongate grate, said oscillating blade including an edge adapted to receive portions of said elongate grate.

8. The combustion appliance of claim 7 wherein said edge adapted to receive portions of said elongate grate and said elongate grate delimit a gap for passage of combustion air.

9. The combustion appliance of claim 7 wherein said burn box further includes an oxygen manifold assembly adjacent to said elongate grate.

10. The combustion appliance of claim 9 wherein said an said oxygen manifold assembly, said elongate grate and said oscillating blade delimit a zone of relative low pressure within said burn box.

11. The combustion appliance of claim 9 wherein said oxygen manifold assembly, said elongate grate and said oscillating blade delimit a fire zone within said burn box.

12. The combustion appliance of claim 11 wherein said oxygen manifold assembly includes a supplemental oxygen manifold for carrying supplemental oxygen to said fire zone.

13. The combustion appliance of claim 12 wherein said supplemental oxygen is supplied by an oxygen concentrator.

14. The combustion appliance of claim 12 wherein said oxygen manifold assembly further includes a manifold plate underlying said supplemental oxygen manifold.

15. The combustion appliance of claim 14 wherein said manifold plate includes an edge adapted to receive portions of said elongate grate.

16. The combustion appliance of claim 15 wherein said edge adapted to receive portions of said elongate grate and said elongate grate delimit a gap for passage of combustion air.

17. The combustion appliance of claim 14 wherein said manifold plate includes a serially notched edge for cooperative registration with portions of said elongate grate.

18. The combustion appliance of claim 14 wherein said manifold plate operatively supports an ignitor assembly.

19. The combustion appliance of claim 18 wherein said manifold plate is adapted to receive an ignitor tube of said ignitor assembly.

20. The combustion appliance of claim 14 wherein said oxygen manifold assembly further includes a manifold cover overlying said supplemental oxygen manifold.

21. The combustion appliance of claim 20 wherein said supplemental oxygen manifold is adapted for selective manipulation for cooperative scraping engagement with portions of either said manifold plate or said manifold cover in furtherance of cleaning same.

22. A combustion appliance for the production of thermal energy from a biofuel, the appliance comprising a burn box adapted to receive a regulated feed of biofuel, said burn box including an elongate grate for receipt of a distributed mass of the regulated feed of biofuel and an oscillating blade adjacent to said elongate grate for agitation of the distributed mass of the regulated feed of biofuel received by said elongate grate, said oscillating blade being substantially co-extensive with said elongate grate, said oscillating blade including a serially notched edge for cooperative registration with portions of said elongate grate.

23. The combustion appliance of claim 22 wherein said burn box further includes an oxygen manifold assembly adjacent to said elongate grate.

* * * * *